US011255078B2

(12) United States Patent
Davis et al.

(10) Patent No.: US 11,255,078 B2
(45) Date of Patent: Feb. 22, 2022

(54) FLUSH VALVE WITH BOWL CLEANING AGENT

(71) Applicant: Delta Faucet Company, Indianapolis, IN (US)

(72) Inventors: DeWayne A. Davis, Lebanon, IN (US); Gary R. Jacobs, Indianapolis, IN (US); Charles W. Hettrick, Westfield, IN (US)

(73) Assignee: Delta Faucet Company, Indianapolis, IN (US)

( * ) Notice: Subject to any disclaimer, the term of this patent is extended or adjusted under 35 U.S.C. 154(b) by 21 days.

(21) Appl. No.: 16/709,353

(22) Filed: Dec. 10, 2019

(65) Prior Publication Data

US 2020/0190783 A1 Jun. 18, 2020

Related U.S. Application Data

(60) Provisional application No. 62/781,329, filed on Dec. 18, 2018.

(51) Int. Cl.
*E03D 9/03* (2006.01)
*E03D 1/34* (2006.01)

(52) U.S. Cl.
CPC ..... *E03D 9/031* (2013.01); *E03D 1/34* (2013.01)

(58) Field of Classification Search
CPC ..... E03D 1/34; E03D 9/031; E03D 9/005; E03D 9/02; E03D 9/022; E03D 9/024; E03D 9/03; E03D 9/038; E03D 9/033; E03D 9/035; E03D 9/037
See application file for complete search history.

(56) References Cited

U.S. PATENT DOCUMENTS 3,060,456 A 10/1962 Jacobs
4,229,410 A * 10/1980 Kosti ..... A61L 9/05 4/222
4,821,346 A * 4/1989 Jones ..... E03D 9/037 4/225.1
5,603,126 A 2/1997 Scoggins
5,815,850 A 10/1998 Shon
6,009,567 A 1/2000 Dean et al.
6,240,572 B1 6/2001 Van Der Gaag et al.
6,321,392 B1 11/2001 Sim
(Continued)

FOREIGN PATENT DOCUMENTS

CN 1688774 A 10/2005
CN 105863015 A 8/2016
(Continued)

OTHER PUBLICATIONS

Fluidmaster 8300 Flush 'n Sparkle Automatic Toilet Bowl Cleaning System; retrieved Sep. 14, 2018 from https://www.amazon.com/Fluidmaster-8300-Sparkle-Automatic-Cleaning/dp/B0002YOQXQ, 9 pages.

*Primary Examiner* — Janie M Loeppke
(74) *Attorney, Agent, or Firm* — Bose McKinney & Evans LLP

(57) ABSTRACT

A toilet cleaning system integrated with a flush valve of a toilet so that a cleaning agent is kept separate from sensitive seals of a tank of the toilet. Additionally, the toilet cleaning system provides a path for the cleaning agent solution to pass through a rim of a bowl of the toilet so that most of the toilet bowl is affected by the solution.

20 Claims, 15 Drawing Sheets

(56) References Cited

U.S. PATENT DOCUMENTS

| | | | | |
|---|---|---|---|---|
| 6,339,850 | B1 | 1/2002 | Gore | |
| 6,662,379 | B2 | 12/2003 | Nguyen et al. | |
| 6,944,890 | B1 | 9/2005 | Sim | |
| 7,073,209 | B1 | 7/2006 | McCormick | |
| 7,634,821 | B2 | 12/2009 | Denzin | |
| 7,895,684 | B2 | 2/2011 | Denzin | |
| 8,095,997 | B2 | 1/2012 | Harris | |
| 8,112,824 | B2 * | 2/2012 | Spogardh | E03D 9/032 4/225.1 |
| 8,453,272 | B2 | 6/2013 | Sim | |
| 8,631,519 | B1 | 1/2014 | Belliard et al. | |
| 8,745,772 | B2 * | 6/2014 | Kido | E03D 1/34 4/378 |
| 2006/0242754 | A1 | 11/2006 | Coppock | |
| 2007/0289054 | A1 | 12/2007 | Han et al. | |
| 2010/0313347 | A1 | 12/2010 | Shieh | |
| 2015/0013057 | A1 | 1/2015 | Bucher et al. | |
| 2015/0013058 | A1 | 1/2015 | Bucher et al. | |
| 2017/0030065 | A1 | 2/2017 | Bucher et al. | |
| 2017/0058500 | A1 * | 3/2017 | Garrels | E03D 1/36 |

FOREIGN PATENT DOCUMENTS

| | | | |
|---|---|---|---|
| CN | 206916870 | U | 1/2018 |
| CN | 207512852 | U | 6/2018 |
| CN | 108431339 | A | 8/2018 |
| CN | 108603368 | A | 9/2018 |
| KR | 2010-0007210 | | 1/2010 |
| KR | 2010-0007210 | U | 7/2010 |
| WO | 2017/035246 | A1 | 3/2017 |
| WO | 2017/062968 | A1 | 4/2017 |
| WO | 2017192492 | | 11/2017 |

* cited by examiner

FLUSH VALVE WITH BOWL CLEANING AGENT

CROSS-REFERENCE TO RELATED APPLICATION

The present application claims priority to U.S. Provisional Patent Application Ser. No. 62/781,329, filed Dec. 18, 2018, the disclosure of which is expressly incorporated herein by reference.

BACKGROUND AND SUMMARY OF THE DISCLOSURE

The present disclosure relates generally to toilet cleaning systems and, more particularly, to toilet cleaning systems that function automatically when a toilet is flushed.

Toilet cleaning systems currently exist separate from a flush valve that provide for a cleaning agent to enter the bowl of the toilet, but not from the rim of the bowl. As a result, only a portion of the bowl may be affected. This problem is sometimes solved by placing the cleaning agent directly into the tank of the toilet, but this solution may be inadequate because the cleaning agent can cause the seals within the tank to deteriorate.

The present disclosure provides a toilet cleaning system integrated with a flush valve of a toilet so that a cleaning agent is kept separate from sensitive seals of a tank of the toilet. Additionally, the toilet cleaning system provides a path for the cleaning agent solution to pass through a rim of a bowl of the toilet so that most of the toilet bowl is affected by the solution.

In an illustrative embodiment, a flush valve for installation in a toilet tank is disclosed. The flush valve includes a valve body having at least one inlet and an outlet, as well as a refill tube coupled to the valve body to create a fluid-tight seal. The refill tube is also fluidly coupled to the at least one inlet of the valve body. The flush valve further comprises a cleaning agent support disposed within the valve body and located within a fluid pathway between the at least one inlet of the valve body and the outlet of the valve body.

Additionally, an illustrative method for cleaning a toilet is disclosed. The method includes the step of providing a toilet having a tank capable of holding water and a flush valve operably coupled to the water within the tank. The flush valve includes a valve body having a first inlet, a second inlet, and an outlet; a refill tube coupled to the valve body to create a fluid-tight seal and fluidly coupled to the first inlet of the valve body and an external water source; a valve cover coupled to the valve body and sized to cover the second inlet of the valve body to create a fluid-tight seal; a cord coupled to the valve cover; and an agent support disposed within the valve body so that the agent support is accessible form the second inlet of the valve body and located within a fluid pathway between the first inlet of the valve body, the second inlet of the valve body, and the outlet of the valve body. The method further includes the steps of lifting the valve cover to acquire access to the agent support; placing a cleaning agent within the agent support; closing the valve cover; filling the tank of the toilet with water; and lifting the valve cover via the cord coupled to the valve cover so that water enters the valve body via the second inlet. The water flows over the cleaning agent, exits the outlet of the valve body, and flows into a toilet bowl. The method also includes the step of filling the refill tube via the external water source so that the water flows through the first inlet of the valve body, over the cleaning agent, exiting the outlet of the valve body, and flows into the toilet bowl.

An additional illustrative method for cleaning a toilet is disclosed. The method includes the step of providing a toilet having a tank holding water and a flush valve operably coupled to the water within the tank. The flush valve includes a valve body having an inlet and an outlet; a refill tube coupled to the valve body to create a fluid-tight seal, fluidly coupled to the first inlet of the valve body and an external water source; and having an opening opposite the valve body sized to receive a cleaning agent; a canister configured to slidably receive the refill tube to form a fluid-tight seal between the canister and the refill tube while leaving a void between an external sidewall of the refill tube and an internal sidewall of the canister; a cord coupled to the canister; and an agent support disposed within the valve body so that the agent support is in communication with the refill tube and located within a fluid pathway between the inlet of the valve body and the outlet of the valve body. The method further includes the steps of dispensing a cleaning agent in the opening of the refill tube so that the cleaning agent is supported by the agent support and lifting the canister via the cord coupled to the canister so that water enters the valve body via the inlet. The water then flows over the cleaning agent, exits the outlet of the valve body and flows into a toilet bowl. The method also includes the step of filling the refill tube via the external water source so that the water flows through the inlet of the valve body, over the cleaning agent, and exits the outlet of the valve body to flow into the toilet bowl.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

Figure 1:
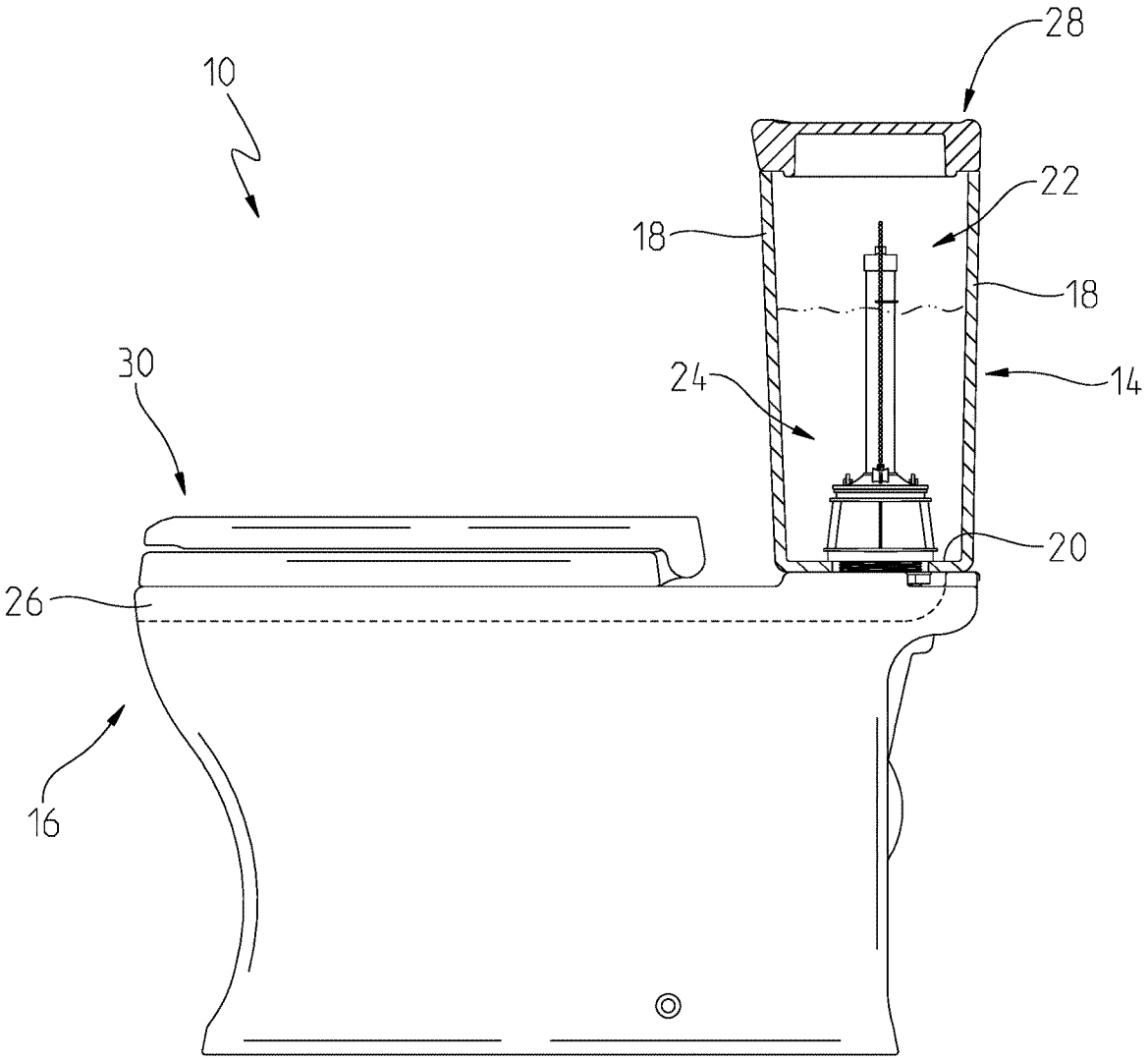
FIG. 1 is a side elevational view, in partial cross-section, of a toilet including an integrated cleaning system.

For the purposes of promoting and understanding of the principles of the present disclosure, reference will now be made to the embodiments illustrated in the drawings, which are described herein.

With reference to FIG. 1, an illustrative toilet 10 is shown as including a toilet tank 14 supported by a toilet bowl 16. More particularly, the illustrative toilet tank 14 includes side walls 18 and a bottom wall 20 defining a chamber 22 and is fluidly coupled to the toilet bowl 16. The toilet tank 14 is configured to supply tank water 24 from the chamber 22 to a rim 26 of the toilet bowl 16. Water 24 may be supplied to the tank 14 from a conventional water source through a fill valve (not shown). A tank cover 28 is illustratively supported by an upper end of the tank 14. Illustratively, the tank 14, the bowl 16 and the cover 28 are formed of vitreous china. A seat assembly 30 is illustratively supported above the toilet bowl 16.

Figure 2:
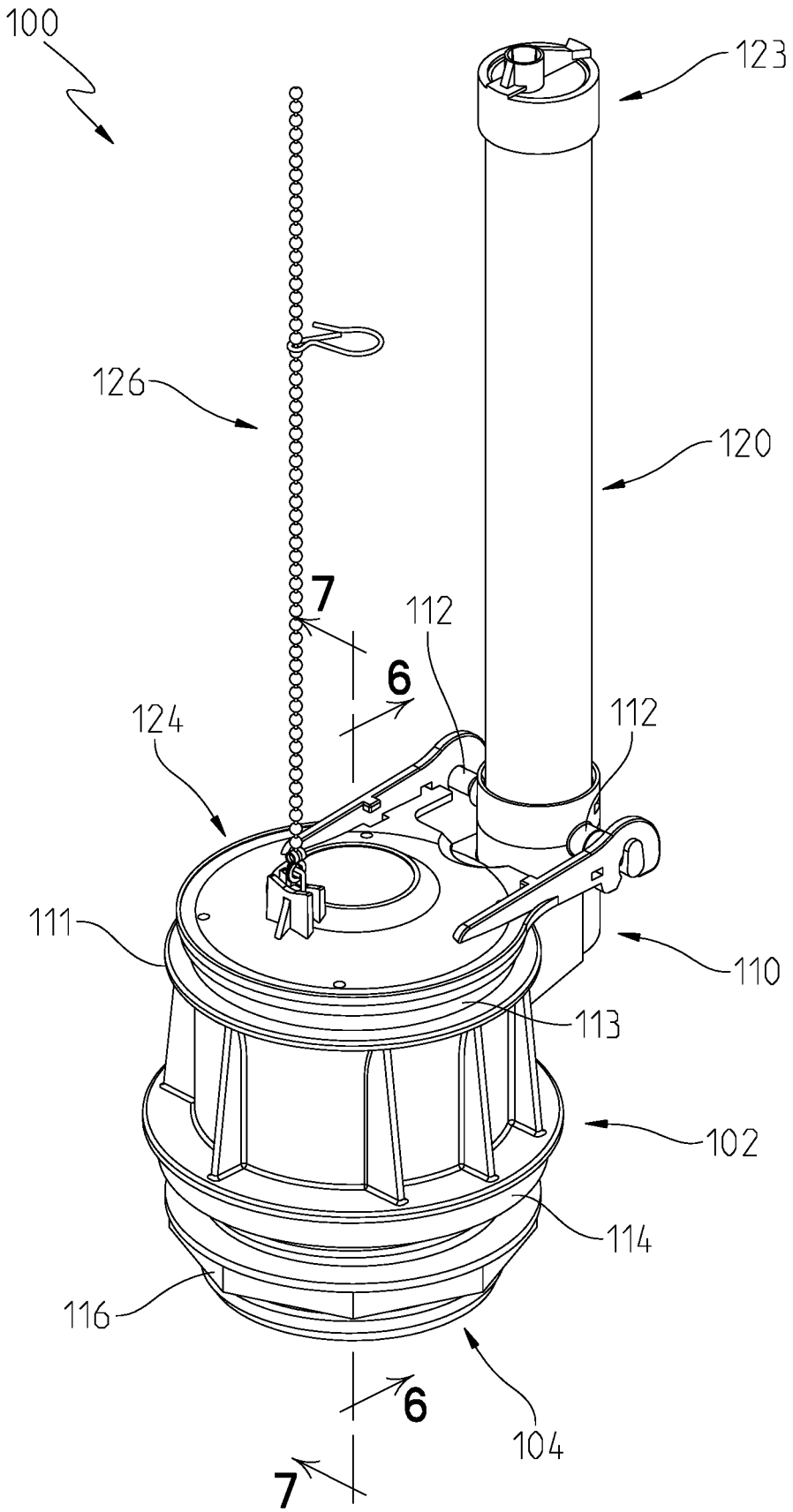
FIG. 2 is a perspective view of a flapper-type flush valve with the integrated cleaning system of FIG. 1.
Figure 3:
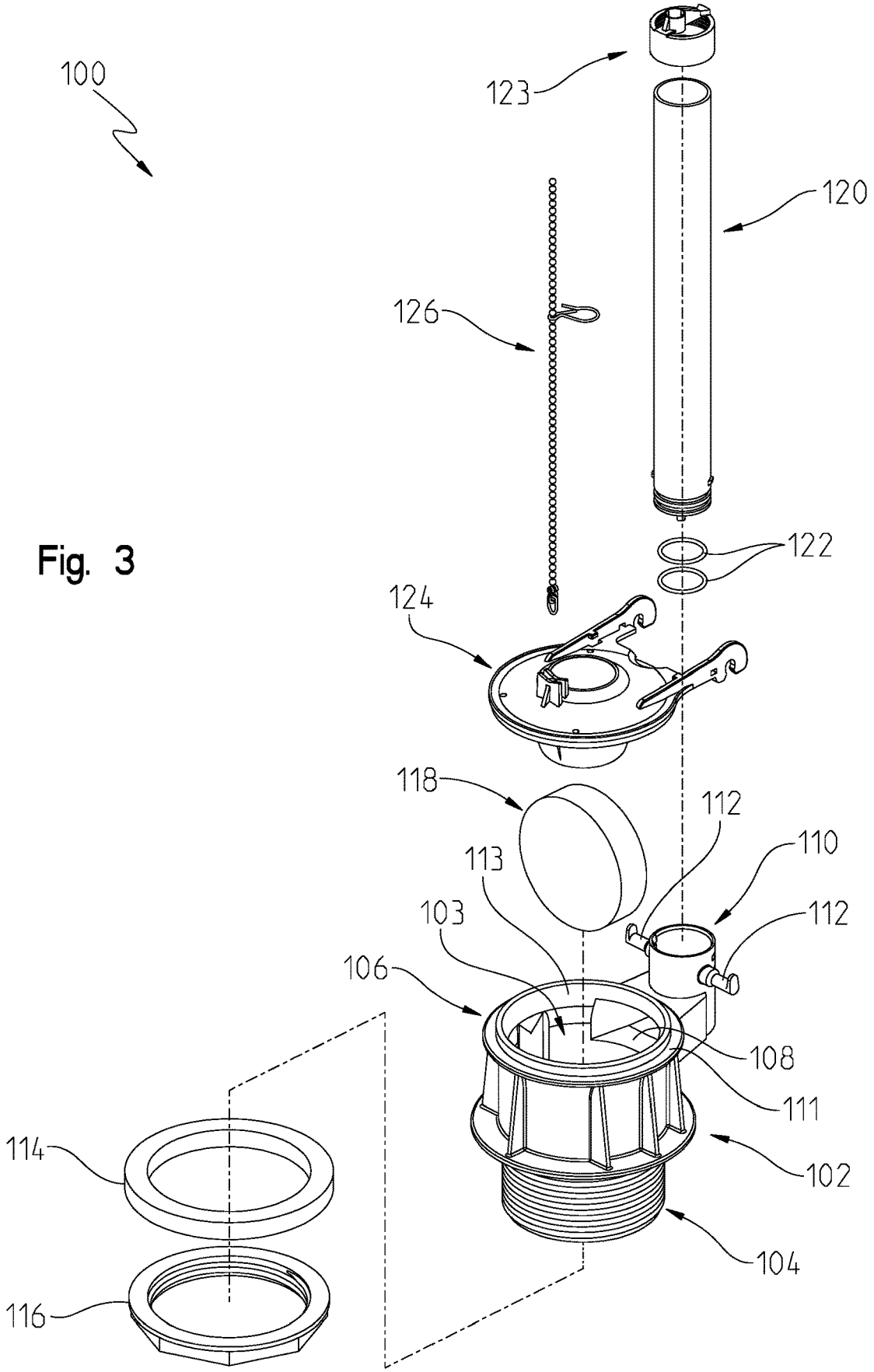
FIG. 3 is an exploded perspective view of the flush valve of FIG. 2.

Referring now to FIGS. 2 and 3, an illustrative flush valve cleaning system 100 is disclosed. Illustratively, cleaning system 100 includes base 102, which may be used in place of a standard flapper flush valve within an existing toilet tank. Base 102 forms valve chamber 103 and includes threaded shank 104, base opening 106, water inlet 108, tube receiver 110, seat 111, mounting arms 112, and base seal 113. Threaded shank 104 is configured to cooperate with shank gasket 114 and shank nut 116 to secure within an opening in the bottom of an existing toilet tank to hold cleaning system 100 in place within the toilet tank. Specifically, shank gasket 114 fits circumferentially around threaded shank 104 to create a water seal between base 102 and the existing toilet tank to avoid the leakage of water. Shank nut 116 cooperates with threaded shank 104 to hold (e.g., clamp) base 102 securely to the toilet tank.

Figure 4:
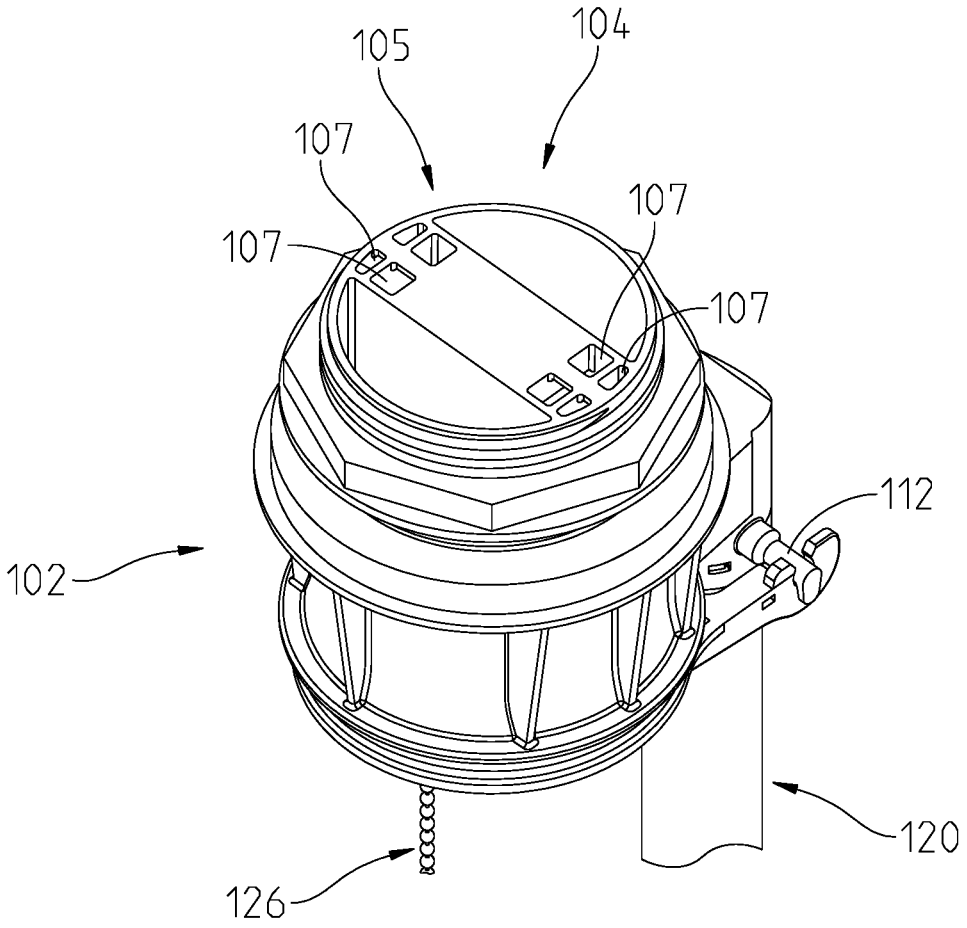
FIG. 4 is a partial bottom perspective view of the flush valve of FIG. 2.

As shown in FIG. 4, illustrative threaded shank 104 includes exit portal 105. Exit portal 105 illustratively includes a plurality of exit openings 107, through which water exits base 102 during a toilet's flush operation. Exit portal 105 enters a tube or other pathway which carries the water from base 102 to a channel leading around the upper interior ledge of a bowl (e.g., bowl rim) of a toilet. Water from the bowl rim may flow into the toilet bowl in a manner known in the art.

Referring generally to FIGS. 2-5, base opening 106 is located opposite threaded shank 104 and is sized to receive cleaning agent 118. Water inlet 108 is located within valve chamber 103 on a sidewall of base 102. In alternate embodiments, water inlet 108 may be located elsewhere on base 102 so that water may flow from water inlet 108 into valve chamber 103. Water inlet 108 is in fluid communication with tube receiver 110. Tube receiver 110 is configured to receive refill tube 120 securely, such as through friction fitting, threaded connectors, or other means. O-rings 122 are fitted between refill tube 120 and tube receiver 110 to create a water seal between refill tube 120 and tube receiver 110 so that water does not leak when transported between refill tube 120 and base 102. Illustratively, refill tube 120 is further fitted with flush valve cap 123.

Mounting arms 112 on base 102 are configured to couple with flapper 124 so that flapper 124 hinges or pivots on mounting arms 112 between a raised open position and a lowered closed position (FIGS. 4 and 2, respectively). As illustrated, mounting arms 112 may be located on base 102 at a point equal to or above base opening 106 and may be located on tube receiver 110. Mounting arms 112 may alternately be located anywhere on base 102 that allows flapper 124 to function. When flapper 124 is coupled to mounting arms 112 and flapper 124 is in a closed position, flapper 124 fits on seat 111 of base 102 and seals against base seal 113. When in said closed position, base seal 113 and flapper 124 create a water seal between flapper 124 and base 102 to prevent the leakage of water from the tank into base opening 106.

Still referring to FIGS. 2-5, flapper 124 is illustratively coupled to pull cord 126 on an upper face of flapper 124. Operation of pull cord 126 results in flapper 124 moving from lowered closed position (FIG. 2) to raised open position (FIG. 4), while lack of engagement with pull cord 126 results in flapper 124 remaining in or returning to a closed position (FIG. 2). Specifically, in an illustrative embodiment and as known in the art, when a toilet enters a flushing operation, a lever on the outside of the toilet tank may be pushed down by a user. The lever is coupled to an interior rod which is coupled to the lever on one end and coupled to pull cord 126 on the other. When the lever is pushed, the interior rod pivots at the point coupled with the lever, causing the end of the interior rod which is coupled to pull cord 126 to rise, pulling flapper 124 to an open position. When flapper 124 is in an open position, water reserved in the tank of the toilet may enter base 102, flow over inserted cleaning agent 118, and exit base 102 via threaded shank 104 into the toilet bowl. In alternate embodiments, pull cord 126 may be coupled to a push button on the external surface of the toilet so that when a user engages the push button, pull cord 126 rises, pulling flapper 124 to an open position. In yet other embodiments, other known configurations may be utilized.

Figure 5:
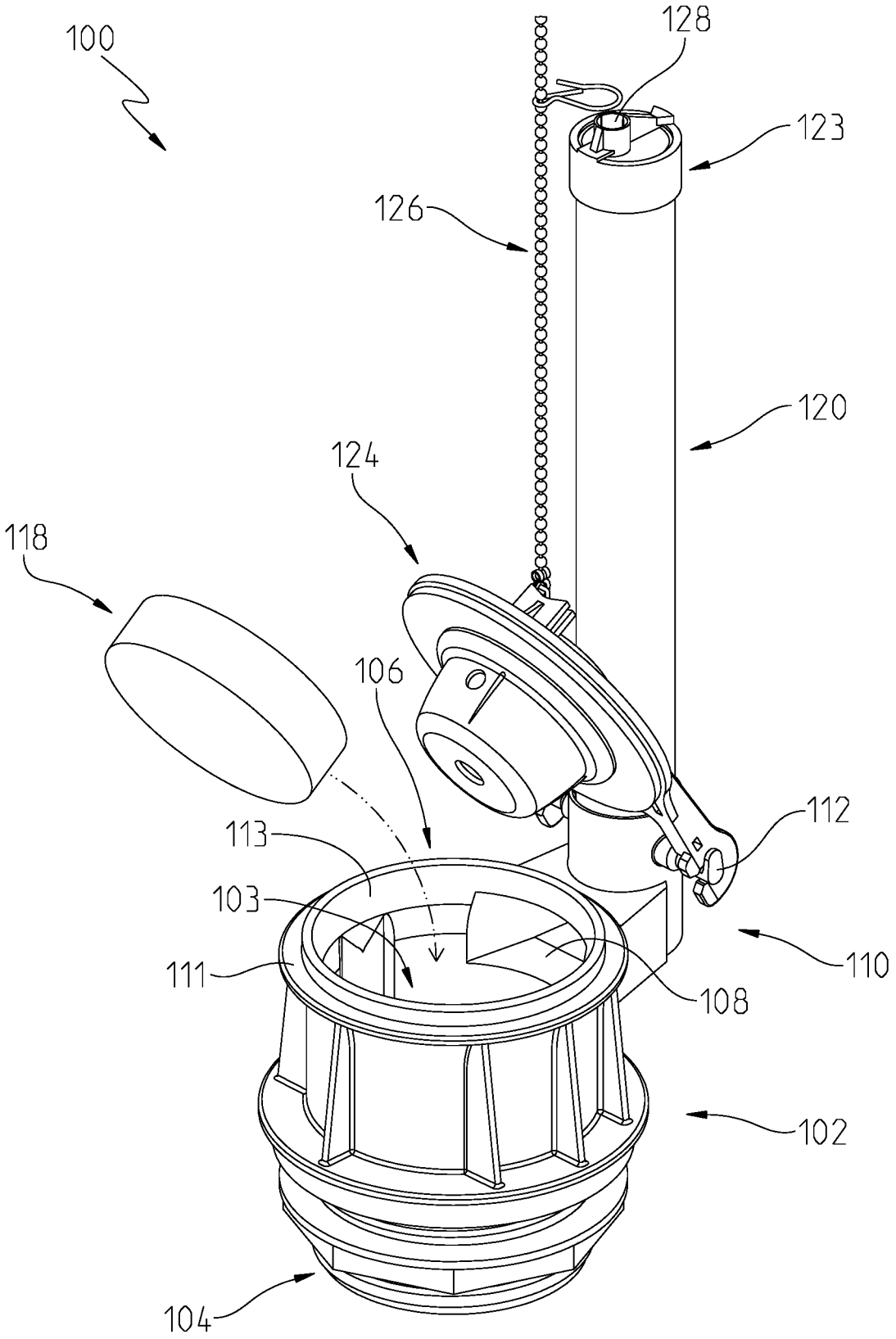
FIG. 5 is a perspective view of the flush valve of FIG. 2, illustrating a flapper of the flush valve in an open position with a cleaning agent being disposed within the flush valve.
Figure 6:
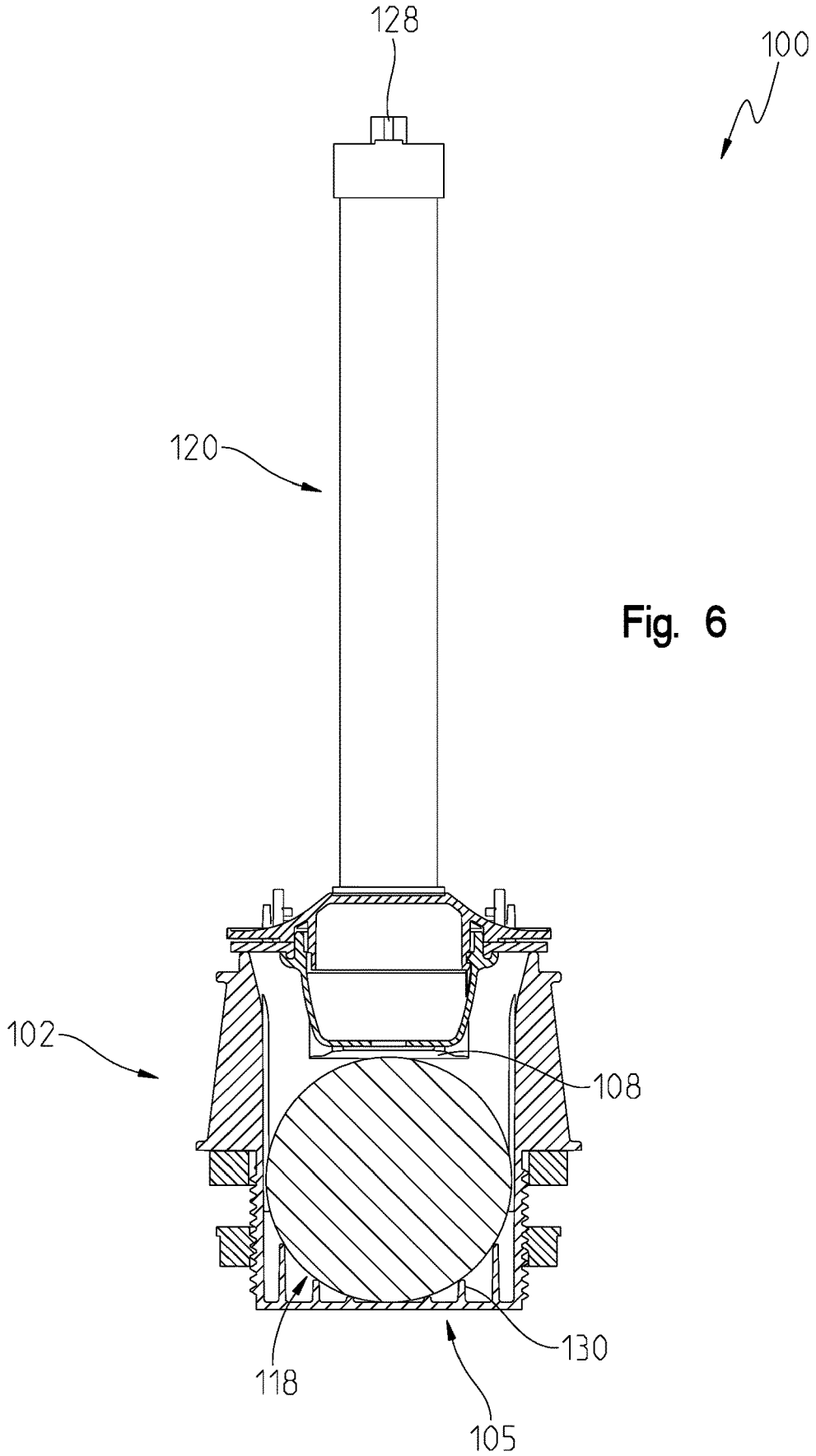
FIG. 6 is a cross-section of a front view of the flush valve of FIG. 2, taken along line 6-6 of FIG. 2.
Figure 7:
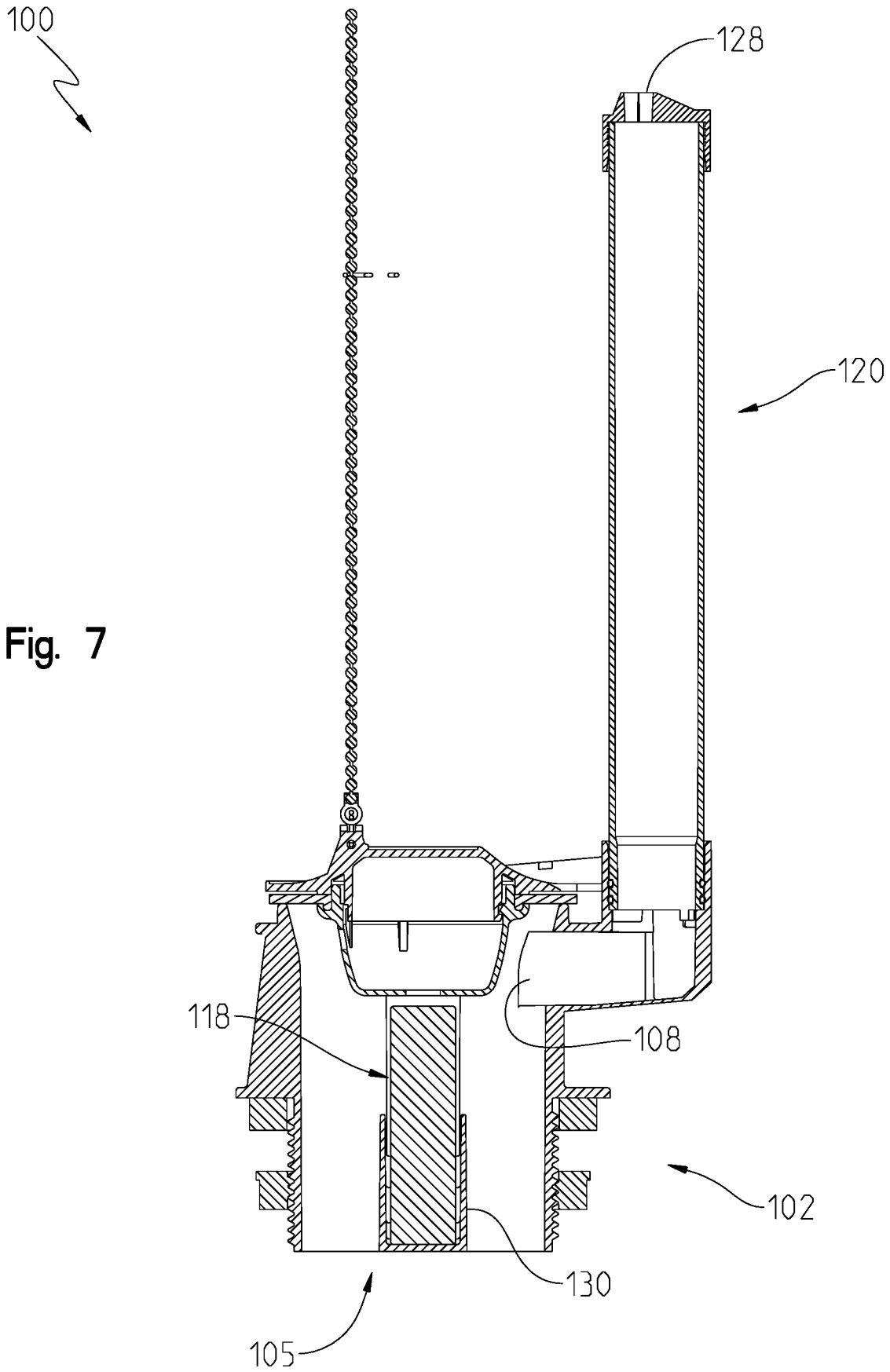
FIG. 7 is a cross section of a side view of the flush valve of FIG. 2, taken along the line 7-7 of FIG. 2.

Referring to FIGS. 5-7, cleaning agent 118 may be inserted into base 102 when flapper 124 is in the open position and settle within base 102 into agent holder 130. In the illustrated embodiment, cleaning agent 118 comprises a disc or puck formed of water soluble materials that aid in the cleaning of a toilet bowl, such as chlorine bleach, borax, or other agents. In alternate embodiments, cleaning agent 118 may comprise other forms of cleaning agents, such as granules received within a housing or container.

Referring generally to FIGS. 2-7, after cleaning agent 118 has been inserted, when a toilet engages in a flushing operation, the water entering base 102 through base opening 106 must flow over cleaning agent 118 to create a solution before exiting the tank via exit portal 105 into the toilet bowl to complete the flushing operation. As a result, the water forms a solution with the cleaning agent, which enters the toilet bowl upon every flushing operation, allowing for consistent cleaning when the flushing operation is utilized.

After the tank empties during a toilet flushing operation, refill tube 120 begins to fill to allow water to remain in the bowl of the toilet between flushing operations. Water enters refill tube 120 via cap opening 128 through a connected water source. The water flows through refill tube 120 and out if water inlet 108 to flow over cleaning agent 118 before entering the toilet bowl, allowing a cleaning solution formed from cleaning agent 118 to remain in the toilet bowl between cleaning operations. In the illustrated embodiment, some water may remain in agent holder 130 as a reservoir, keeping a reserved amount of cleaning solution within cleaning system 100 for use during the next flushing operation.

Figure 8:
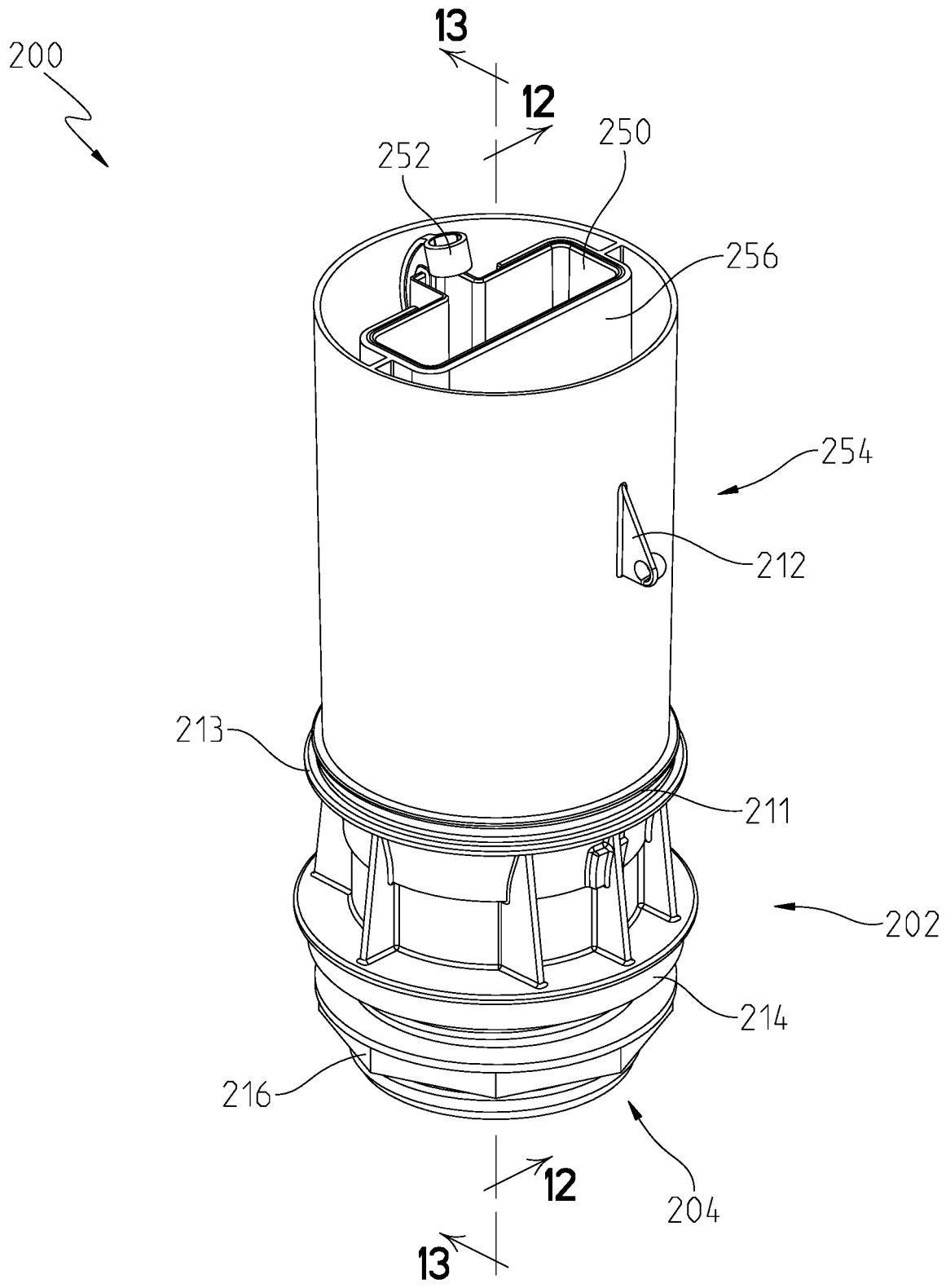
FIG. 8 is a perspective view of a canister-type flush valve with an integrated cleaning system.
Figure 9:
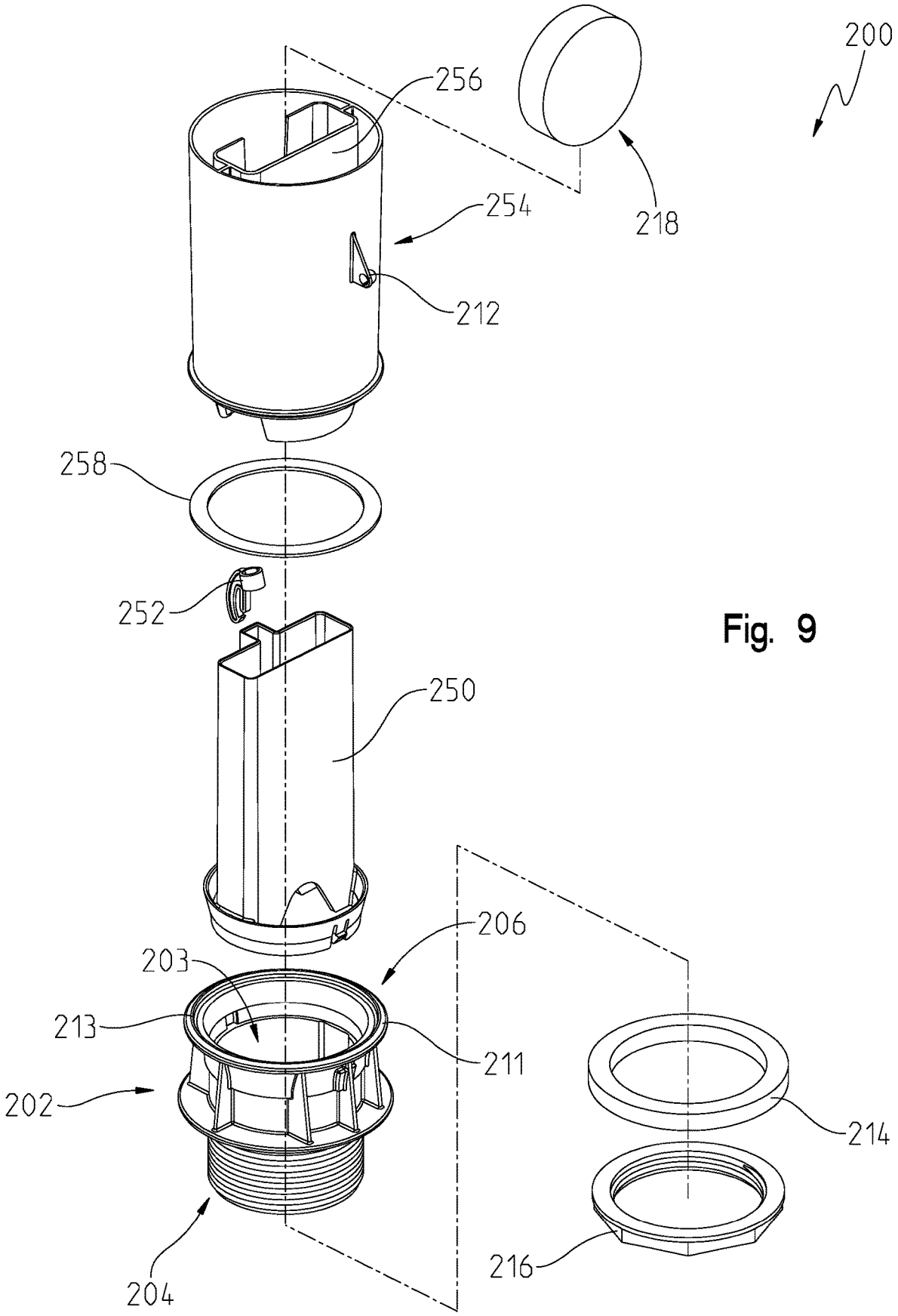
FIG. 9 is an exploded perspective view of the flush valve of FIG. 8.

Turning to FIGS. 8-15, a further illustrative embodiment is shown. Referring particularly to FIGS. 8 and 9, a flush valve cleaning system 200 is disclosed. Illustrative cleaning system 200 includes base 202, which forms valve chamber 203 and includes threaded shank 204, base opening 206, seat 211, and base seal 213. Threaded shank 204 is configured to cooperate with shank gasket 214 and shank nut 216 to secure within an opening in the bottom of an existing toilet tank to hold cleaning system 200 in place within the toilet tank. Specifically, shank gasket 214 fits circumferentially around threaded shank 204 to create a water seal between base 202 and the existing toilet tank to avoid the leakage of water. Shank nut 216 cooperates with threaded shank 204 to hold (e.g., clamp) base 202 securely to the toilet tank.

Figure 10:
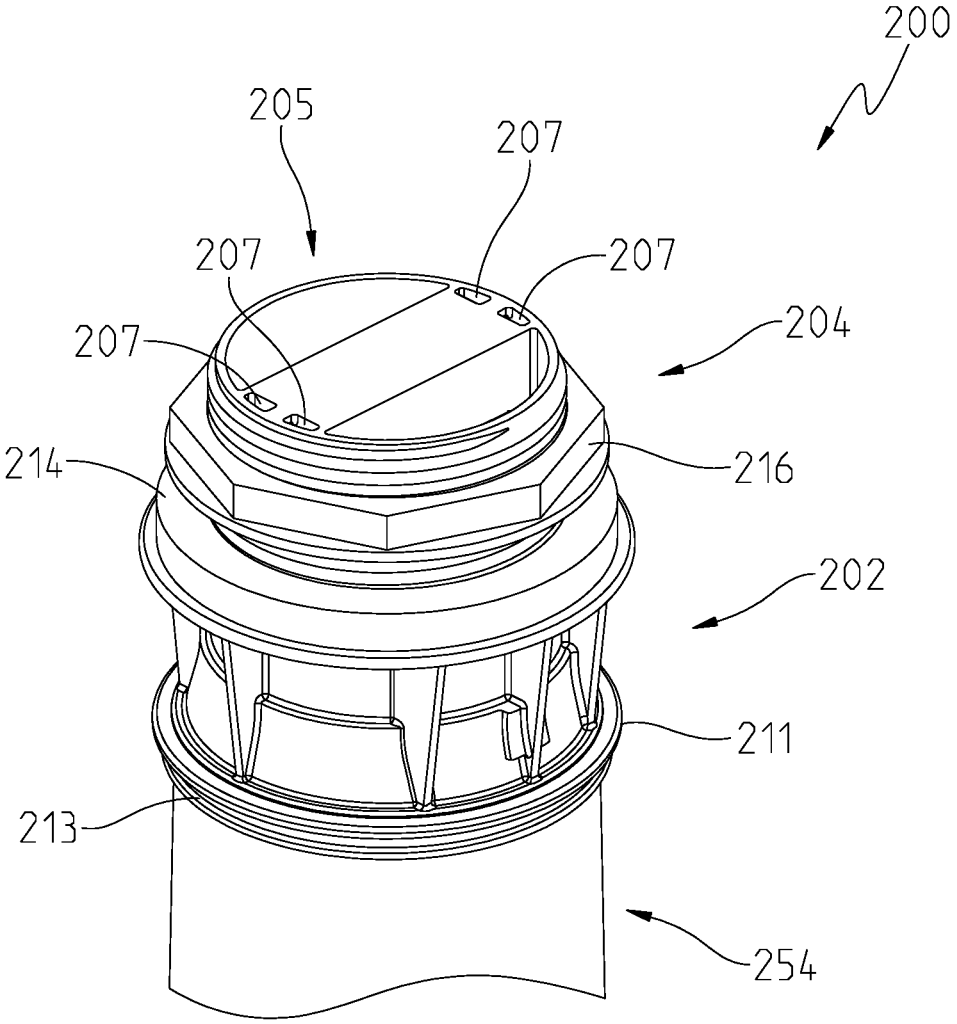
FIG. 10 is a partial bottom perspective view of the flush valve of FIG. 8.
Figure 11:
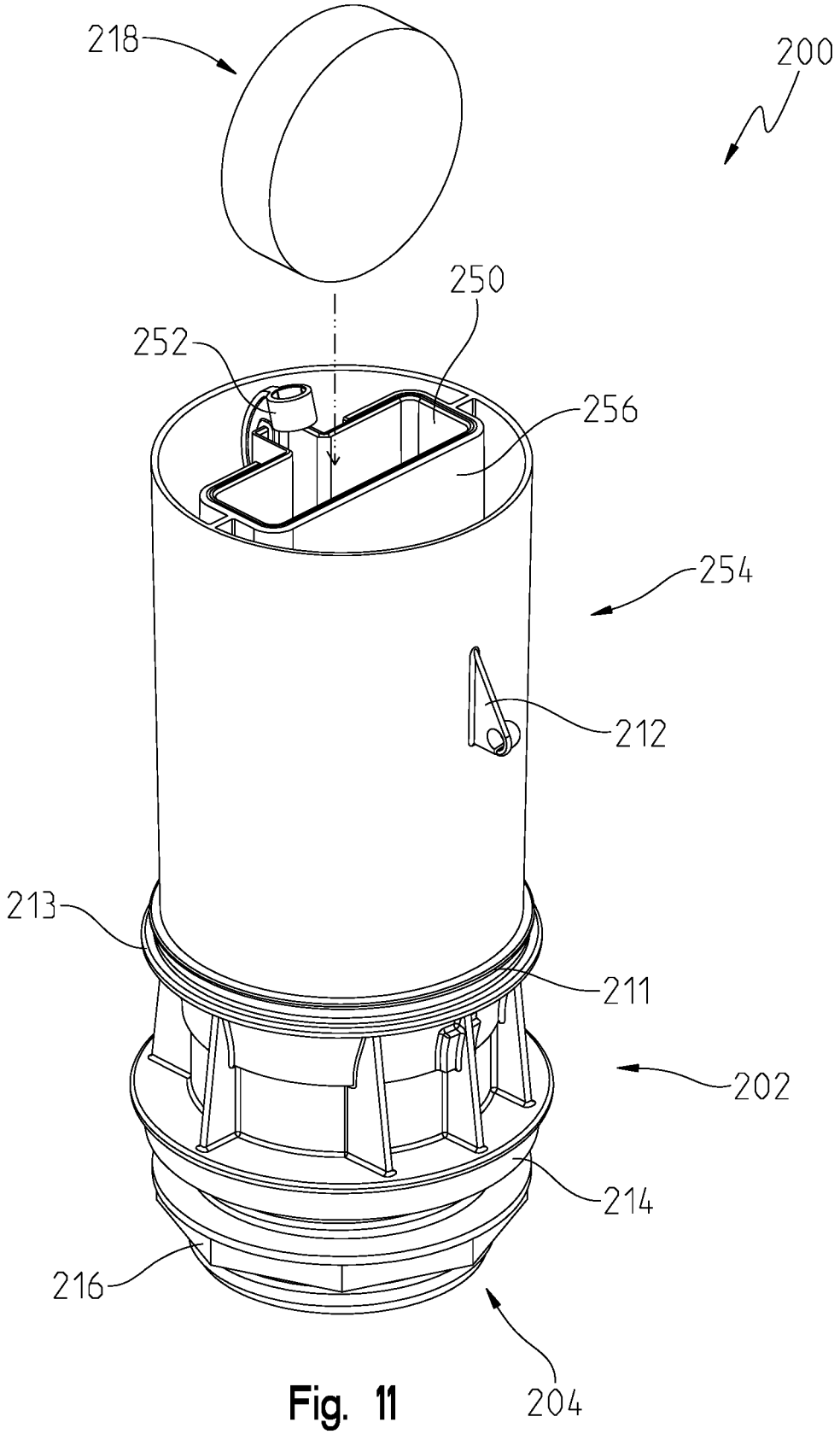
FIG. 11 is a perspective view of the flush valve of FIG. 8, illustrating a cleaning agent being received within the flush valve.
Figure 12:
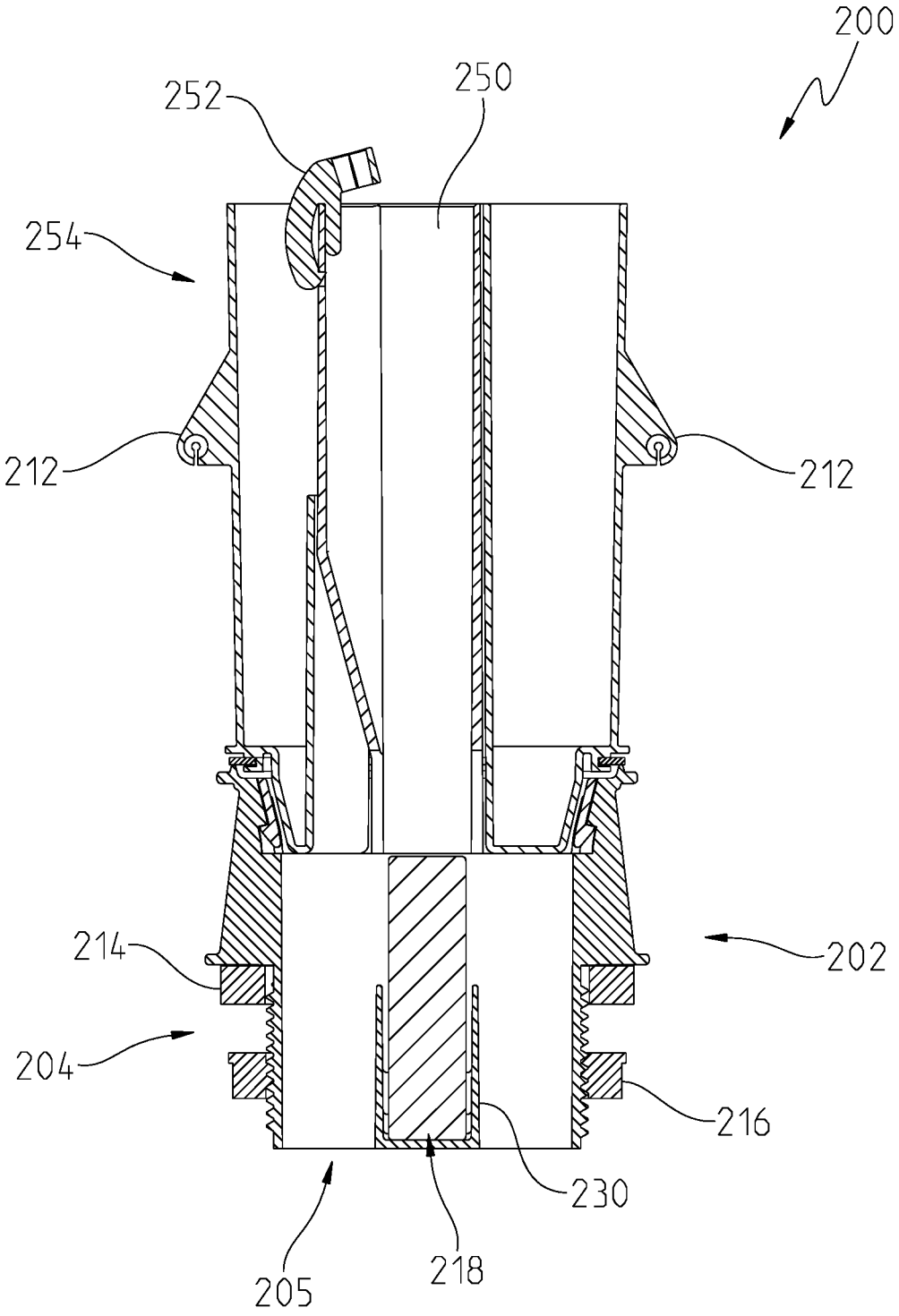
FIG. 12 is a cross section of a front view of the flush valve of FIG. 8, taken along the line 12-12 of FIG. 8.
Figure 13:
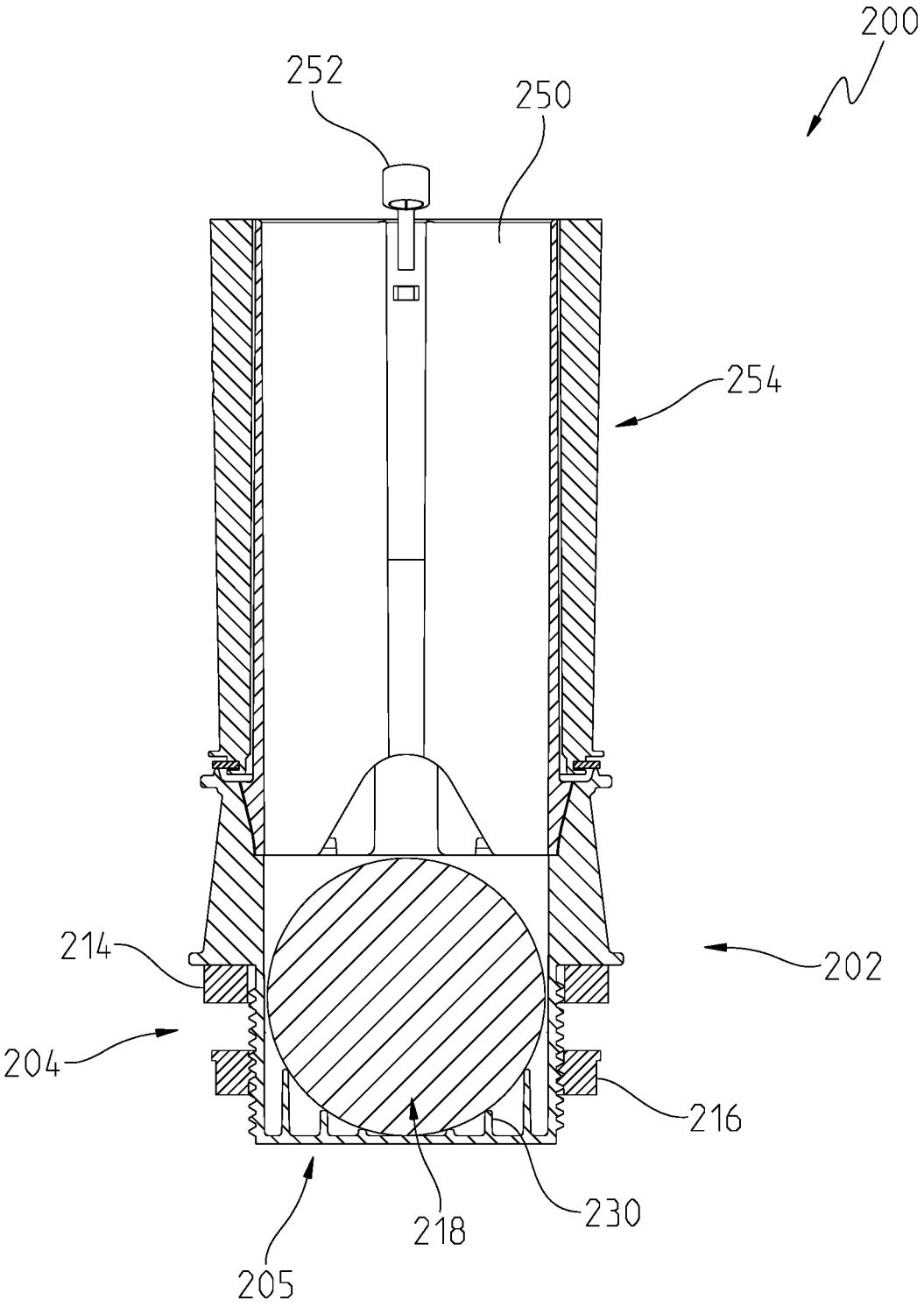
FIG. 13 is a cross section of a side view of the flush valve of FIG. 8, taken along the line 13-13 of FIG. 8.
Figure 14:
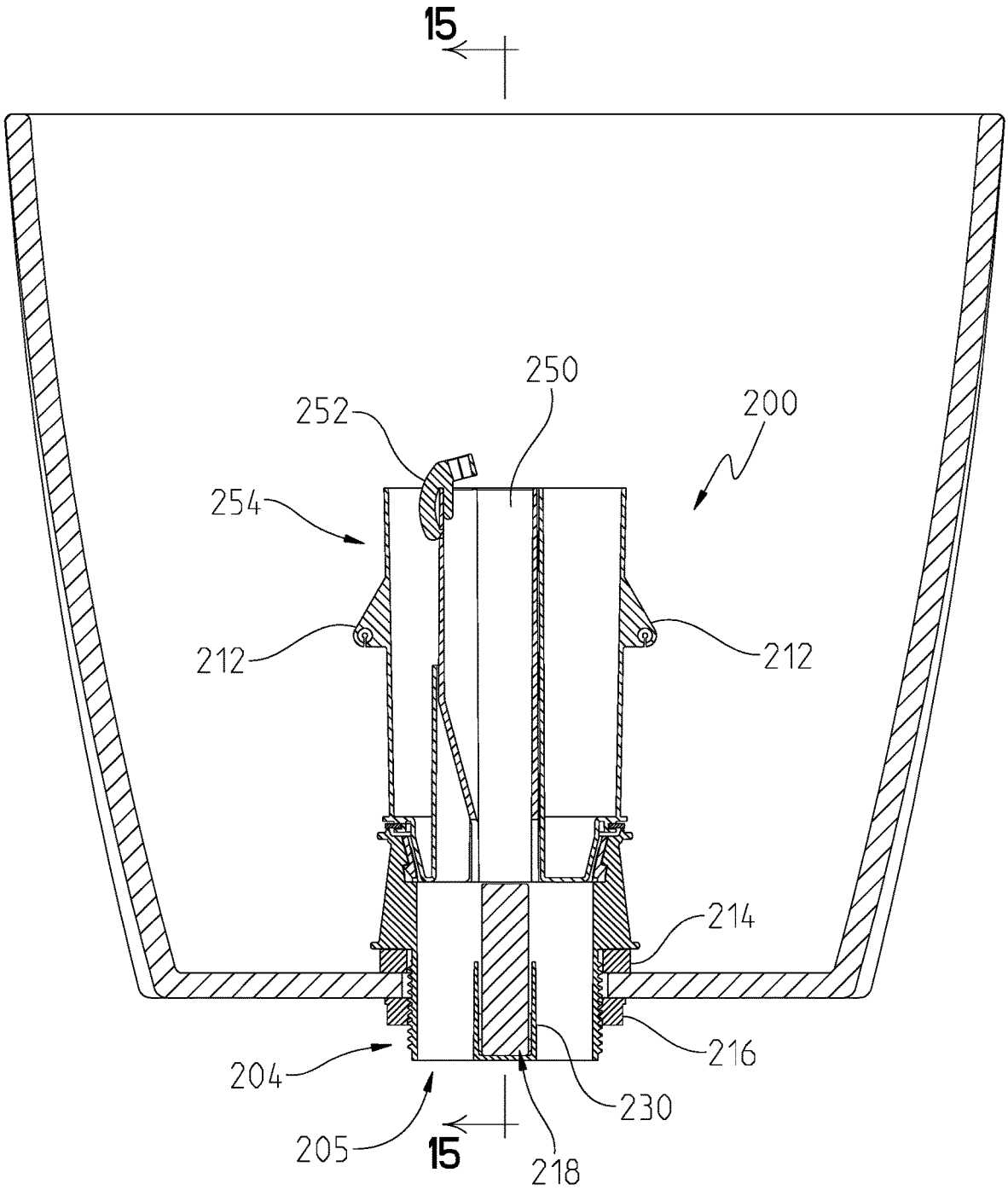
FIG. 14 is a cross section of a front view of the flush valve of FIG. 8 received within a tank of a toilet.
Figure 15:
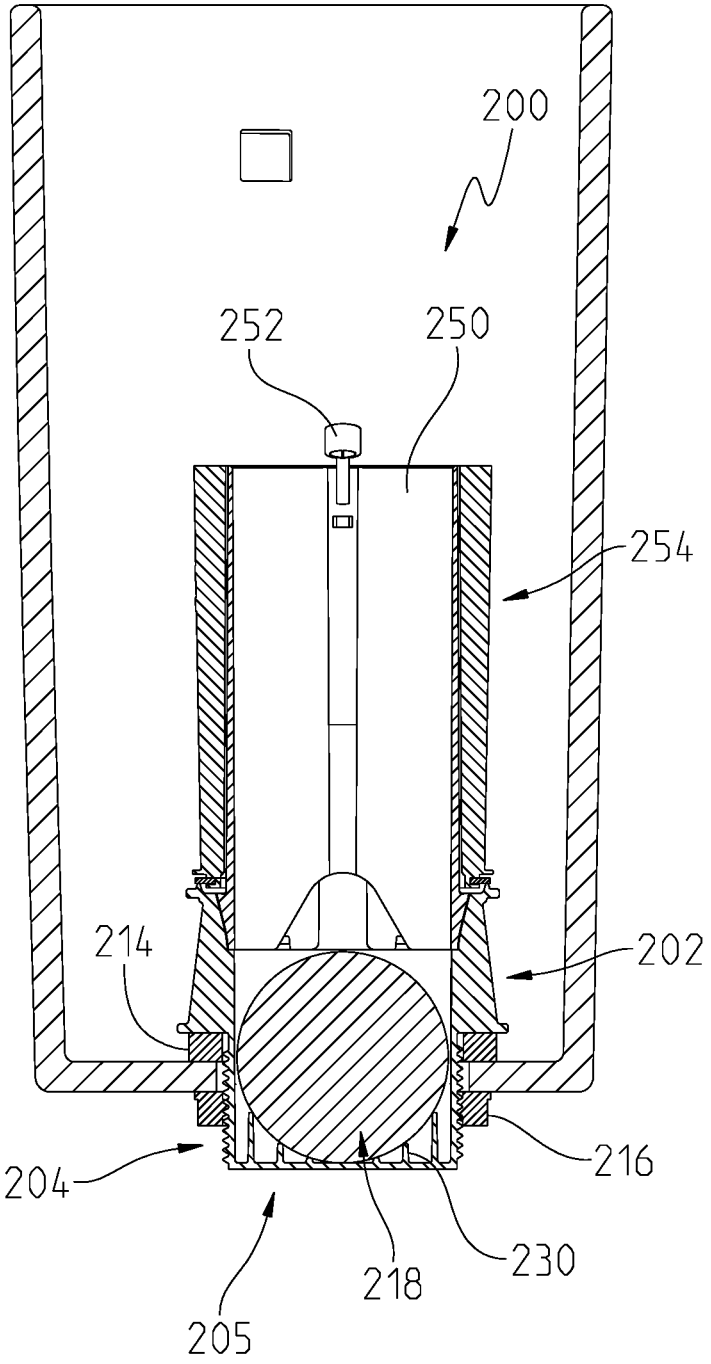
FIG. 15 is a cross section of a side view of the flush valve of FIG. 8, taken along the line 15-15 of FIG. 14.

As shown in FIG. 10, illustrative threaded shank 204 includes exit portal 205. Exit portal 205 illustratively includes a plurality of exit openings 207, through which water exits base 202 during a toilet's flush operation. Exit portal 205 enters a tube or other pathway which carries the water from base 202 to a channel leading around the upper interior ledge of a bowl (e.g., bowl rim) of a toilet. Water from the bowl rim may flow into the toilet bowl in a manner known in the art.

Referring generally to FIGS. 8-11, refill tube 250 is configured to sit on seat 211 of base 202 and cooperate with seat 211 and base seal 213 to create a water seal between refill tube 250 and base 202 so that water does not leak when transported between refill tube 250 and base 202. Refill tube 250 is shaped to receive cleaning agent 218, as well as water from a water source as provided by refill clip 252, which couples to a sidewall of refill tube 250.

Referring to FIGS. 8-15, cleaning system 200 further includes canister 254. Canister 254 includes tube opening 256, which is shaped to slide over refill tube 250 to couple with refill tube 250. Canister 254 further includes at least one mounting arm 212 so that a pull cord or other lever device may couple to canister 254 to engage a toilet flushing operation.

Mounting arm 212 may be located anywhere on the external sidewall that allows canister 254 to function. When canister 254 is in a closed position, canister 254 fits over refill tube 250 and seals against canister gasket 258. When in said closed position, canister gasket 258 and canister 254 creates a water seal between canister 254 and refill tube 250 to prevent the leakage of water from the tank into base 202.

A pull cord (not shown) is illustratively coupled to canister 254 via mounting arm 212. Operation of the pull cord results in canister 254 moving from a lowered closed position (FIG. 8) to a raised open position, while lack of engagement with the pull cord results in canister 254 remaining in or returning to the closed position (FIG. 8). Specifically, in an illustrative embodiment, when a toilet enters a flushing operation, a lever on the outside of the toilet tank may be pushed down by a user. The lever is coupled to an interior rod which is coupled to the lever on one end and coupled to the pull cord on the other. When the lever is pushed, the interior rod pivots at the point coupled with the lever, causing the end of the interior rod coupled to the pull cord to rise, pulling canister 254 to an open position. When canister 254 is in an open position, water reserved in the tank of the toilet may enter base 202, via the circumference of base opening 206, flow over inserted cleaning agent 218, and exist base 202 via threaded shank 204 into the toilet bowl. In alternate embodiments, pull cord 226 may be coupled to a push button on the external surface of the toilet so that when a user engages the push button, the pull cord 226 rises, pulling canister 254 to an open position. In yet other embodiments, other known configurations may be utilized.

Referring to FIGS. 11-15, cleaning agent 218 may be inserted into refill tube 250. After insertion, cleaning agent 218 travels through refill tube 250 and settles into agent holder 230 within base 202. In the illustrated embodiment, cleaning agent 218 comprises a disc or puck formed of water soluble materials that aid in the cleaning of a toilet bowl, such as chlorine bleach, borax, or other agents. In alternate embodiments, cleaning agent 218 may comprise other forms of cleaning agents, such as granules received within a housing or container.

Referring generally to FIGS. 8-15, after cleaning agent 218 has been inserted, when a toilet engages in a flushing operation, the water entering base 202 must flow over cleaning agent 218 before exiting the tank via 205 into the toilet bowl to complete the flushing operation. As a result, the water forms a solution with the cleaning agent, which enters the toilet bowl upon every flushing operation, allowing for consistent cleaning when the flushing operation is utilized.

After the tank of the toilet empties during a toilet operation, refill tube 250 begins to fill to allow water to remain in the bowl of the toilet between flushing operations. Water enters refill tube 250 via refill clip 252 and enters base 202 to flow over cleaning agent 218 before entering the toilet bowl, allowing a cleaning solution formed from cleaning agent 218 and the water to remain in the toilet bowl between flushing operations. In the illustrated embodiment, some water may remain in agent holder 230 as a reservoir, keeping a reserved amount of cleaning solution within cleaning system 200 for use during the next flushing operation.

Although the invention has been described in detail with reference to certain preferred embodiments, variations and modifications exist within the spirit and scope of the invention as described and defined in the following claims.

What is claimed is:

1. A flush valve for installation in a toilet tank, the flush valve comprising:

a valve body having at least one inlet and an outlet, the valve body being adapted to at least partially project into the toilet tank with the at least one inlet being disposed on the valve body within the toilet tank;

a refill tube coupled to the valve body to create a fluid-tight seal, the refill tube also fluidly coupled to the at least one inlet of the valve body;

a reservoir disposed within the valve body and fluidly coupled to the at least one inlet of the valve body and the outlet of the valve body and wherein the reservoir is adapted to be at least partially disposed within the toilet tank;

a cleaning agent support adapted to support a cleaning agent, the cleaning agent support being disposed at the outlet within the reservoir of the valve body and located within a fluid pathway between the at least one inlet of the valve body and the outlet of the valve body, wherein the cleaning agent support extends over only a portion of the outlet and has a bottom wall defining a plurality of exit openings and wherein the cleaning agent support has two opposed ends, the two opposed ends being engaged with a sidewall of the valve body at diametrically opposite locations on the sidewall of the valve body, the cleaning agent support extending between the two opposed ends thereby bisecting the outlet; and wherein the valve body is adapted to convey water along the fluid pathway from the refill tube through the reservoir over the cleaning agent to the outlet of valve body to refill a toilet bowl and is also adapted to convey water along the fluid pathway from the toilet tank through the reservoir over the cleaning agent to the outlet of the valve body during flushing operation of the flush valve.

2. The flush valve of claim 1, further comprising a canister configured to slidably receive the refill tube to form a fluid-tight seal between the canister and the refill tube while leaving a void between an external sidewall of the refill tube and an internal sidewall of the canister.

3. The flush valve of claim 2, wherein the refill tube further comprises an opening opposite the valve body, the opening sized to receive the cleaning agent.

4. The flush valve of claim 3, wherein the opening of the refill tube coincides with the cleaning agent support so that the refill tube is configured to deliver the cleaning agent to the cleaning agent support.

5. The flush valve of claim 2, wherein the canister further comprises at least one mounting arm, the mounting arm coupled to a cord operably coupled to a flushing system of a toilet.

6. The flush valve of claim 1, wherein the valve body further comprises a second inlet sized to receive a cleaning agent.

7. The flush valve of claim 6, wherein the cleaning agent support is accessible through the second inlet.

8. The flush valve of claim 6, further comprising a valve cover coupled to the valve body and sized to cover the second inlet to create a fluid-tight seal.

9. The flush valve of claim 8, wherein an opening defined by an upper end of the valve body forms the second inlet, wherein the valve cover is coupled to a cord operably coupled to a flushing system of a toilet whereby lifting the valve cover from the second inlet allows water from the toilet tank to enter the second inlet and thereby initiates the flushing operation of the flush valve and wherein the at least one inlet includes a first inlet disposed on the sidewall of the valve body between the second inlet and the outlet, the refill tube being fluidly coupled to the first inlet whereby the valve body is adapted to convey water from the refill tube through the reservoir over the cleaning agent to the outlet of the valve body with the valve cover sealing the second inlet.

10. The flush valve of claim 1, wherein the cleaning agent is located within the cleaning agent support.

11. The flush valve of claim 10, wherein the cleaning agent comprises a pressed disc comprised of chemicals for cleaning a toilet.

12. The flush valve of claim 10, wherein the cleaning agent is water-soluble.

13. The flush valve of claim 1 wherein the valve body has a lower portion which defines a threaded shank configured for insertion through an opening in a bottom wall of the toilet tank and an upper portion configured for mounting within the toilet tank and wherein the outlet is disposed at the lower end of the threaded shank.

14. The flush valve of claim 1 wherein the bottom wall defines a pair of outer edges which extend between the two opposed ends and wherein the pair of outer edges are parallel with each other.

15. The flush valve of claim 1 wherein the bottom wall defines a pair of outer edges which extend between the two opposed ends and wherein the pair of outer edges are linear edges.

16. A method for cleaning a toilet, the method comprising the steps of:

providing a toilet having a tank capable of holding water and a flush valve operably coupled to the water within the tank, the flush valve comprising:

a valve body defining a reservoir and having a first inlet, a second inlet, and an outlet wherein the valve body at least partially projects into the tank with the first and second inlet being disposed on the valve body within the tank and the reservoir being at least partially disposed within the tank;

a refill tube coupled to the valve body to create a fluid-tight seal, the refill tube fluidly coupled to the first inlet of the valve body and an external water source;

a valve cover coupled to the valve body and sized to cover the second inlet of the valve body to create a fluid-tight seal;

a cord coupled to the valve cover; and an agent support disposed at the outlet within the reservoir of the valve body so that the agent support is accessible from the second inlet of the valve body and located within a first fluid pathway between the first inlet of the valve body and the outlet of the valve body, and within a second fluid pathway between the second inlet of the valve body and the outlet of the valve body, wherein the agent support extends over only a portion of the outlet and has a bottom wall defining a plurality of exit openings and wherein the agent support has two opposed ends, the two opposed ends being engaged with a sidewall of the valve body at diametrically opposite locations on the sidewall of the valve body, the agent support extending between the two opposed ends thereby bisecting the outlet;

lifting the valve cover to acquire access to the agent support;

placing a cleaning agent within the agent support;

closing the valve cover;

filling the tank of the toilet with water;

lifting the valve cover via the cord coupled to the valve cover so that water enters the valve body via the second inlet, the water flowing along the second fluid pathway through the reservoir over the cleaning agent, exiting the outlet of the valve body, and flowing into a toilet bowl to flush the toilet bowl; and filling the refill tube via the external water source, the water flowing along the first fluid pathway through the first inlet of the valve body, through the reservoir over the cleaning agent, exiting the outlet of the valve body, and flowing into the toilet bowl to refill the toilet bowl.

17. The method of claim 16, wherein the cleaning agent comprises a pressed disc comprised of chemicals for cleaning a toilet.

18. The method of claim 16, wherein an opening defined by an upper end of the valve body forms the second inlet and wherein the first inlet is disposed on the sidewall of the valve body between the second inlet and the outlet whereby the valve body is adapted to convey water from the refill tube through the reservoir over the cleaning agent to the outlet of the valve body with the valve cover sealing the second inlet.

19. A method for cleaning a toilet, the method comprising the steps of:

providing a toilet having a tank holding water and a flush valve operably coupled to the water within the tank, the flush valve comprising:

a valve body having an inlet, an outlet and a reservoir disposed between the inlet and the outlet wherein the valve body at least partially projects into the tank and at least a portion of the reservoir is disposed within the tank;

a refill tube coupled to the valve body to create a fluid-tight seal, fluidly coupled to the inlet of the valve body and an external water source, and having an opening opposite the valve body sized to receive a cleaning agent;

a canister configured to slidably receive the refill tube to form a fluid-tight seal between the canister and the refill tube in a first position of the canister while leaving a void between an external sidewall of the refill tube and an internal sidewall of the canister;

a cord coupled to the canister; and an agent support disposed at the outlet within the reservoir of the valve body so that the agent support is in communication with the refill tube and located within a fluid pathway between the inlet of the valve body and the outlet of the valve body, wherein the agent support extends over only a portion of the outlet and has a bottom wall defining a plurality of exit openings and wherein the agent support has two opposed ends, the two opposed ends being engaged with a sidewall of the valve body at diametrically opposite locations on the sidewall of the valve body, the agent support extending between the two opposed ends thereby bisecting the outlet;

dispensing a cleaning agent in the opening of the refill tube so that the cleaning agent is supported by the agent support;

lifting the canister via the cord coupled to the canister to a second position of the canister so that water enters the valve body via the inlet, the water flowing along the fluid pathway from the inlet through the reservoir over the cleaning agent, exiting the outlet of the valve body, and flowing into a toilet bowl to thereby flush the toilet bowl; and filling the refill tube via the external water source with the canister in the first position, the water flowing from the refill tube through the inlet of the valve body, along the fluid pathway from the inlet through the reservoir over the cleaning agent, exiting the outlet of the valve body, and flowing into the toilet bowl to thereby refill the toilet bowl.

20. The method of claim 19, wherein the cleaning agent comprises a pressed disc comprised of chemicals for cleaning a toilet.

* * * * *